US005366525A

United States Patent [19]

Fujiyama

[11] Patent Number: 5,366,525

[45] Date of Patent: Nov. 22, 1994

[54] MANUFACTURE OF ABRASIVE TAPE

[75] Inventor: Masaaki Fujiyama, Kanagawa, Japan

[73] Assignee: Fuji Photo Film Co., Ltd., Kanagawa, Japan

[21] Appl. No.: 78,646

[22] Filed: Jun. 21, 1993

[30] Foreign Application Priority Data

Jun. 22, 1992 [JP] Japan ..... 4-162921

[51] Int. Cl.[5] ..... B24D 11/00

[52] U.S. Cl. ..... 51/295; 427/366

[58] Field of Search ..... 427/190, 194, 365, 366; 51/295

[56] References Cited

U.S. PATENT DOCUMENTS 4,288,526 9/1981 Oda et al. ..... 430/272

FOREIGN PATENT DOCUMENTS 55-117730 9/1980 Japan .
63-16980 1/1988 Japan .
1-299086 12/1989 Japan .

OTHER PUBLICATIONS

English language abstract for Japanese Unexamined Patent Publication No. 63-16980. (Jun. 1988).

English language abstract for Japanese Unexamined Patent Publication No. 55-117730 (Nov. 1980).

*Primary Examiner*—Shrive Beck
*Assistant Examiner*—Katherine A. Bareford
*Attorney, Agent, or Firm*—Sughrue, Mion, Zinn, Macpeak & Seas

[57] ABSTRACT

A manufacturing method, for an abrasive tape used for the burnishing of items such as floppy disks, which significantly reduces resulting scratches. An abrasive tape is manufactured by the steps of applying a coating liquid which contains as a major composition abrasive particles and a binder resin to a flexible substrate; drying the flexible substrate to produce an abrasive layer; and subjecting the abrasive layer to a surface smoothing treatment in order to align the tip ends of the abrasive particles to a uniform position by passing the abrasive layer between pressure rollers in such a manner that the flexible substrate comes in contact with an elastic roller, whereas the abrasive layer comes in contact with a metal roller, and wherein the pressure rollers are composed of the elastic roller having a hardness of 50–80 measured by a spring type hardness tester A and the metal roller, and are arranged opposite to each other.

2 Claims, 1 Drawing Sheet

MANUFACTURE OF ABRASIVE TAPE

BACKGROUND OF THE INVENTION

1. Field of the Invention

This invention relates to a manufacturing method for an abrasive tape used when a magnetic recording medium, or the like, is polished, and more particularly to a manufacturing method for an abrasive tape for burnishing items such as floppy disks which can reduce possible resultant scratches to a minimum.

2. Description of the Prior Art

In burnishing processing for floppy disks, the floppy disk is polished by means of an abrasive tape which is produced by applying an abrasive layer containing abrasives, binders, additives, and the like, on a flexible substrate, and by drying the abrasive layer. This abrasive tape is formed into a tape or a disk, and also provided with a flexible substrate, so that it is suitable for processing of a curved surface of magnetic heads and the abrasion of flexible items such as floppy disks when compared with existing hones. In addition, this abrasive tape causes the surface to be polished to suffer from less damage, and enables the precise abrasion of the flexible items, so that this tape is indispensable for finishing abrasions.

In accordance with the tendency in recent years of magnetic recording orientating toward a high recording density, further improvements in the accuracy of the burnishing processing of floppy disks have been anticipated, and, therefore, scratches made on the surface of the magnetic layers of floppy disks during the burnishing process presented a major problem. Meanwhile, several approaches have already been put forward for preventing scratches of, or the attachment of abrasion wastes to, the surface to be polished without causing abrasive effects from being damaged when a magnetic head is finished using an abrasive tape.

One example of such approaches is disclosed in Japanese Unexamined Patent Publication No. 63(1988)-16980, wherein protuberances and recesses are evenly produced on the surface of an abrasive layer by embossing processing so that resultant abrasion wastes can be caught in the recesses, whereby it is possible to prevent scratches arising from the compressive sliding of the abrasive layer over the surface of a magnetic head to be polished, or the like. However, in the burnishing processing of items such as a floppy disk, an abrasive particle of abrasive particles on an abrasive layer which tends to cause a larger amount of particles to fly away from the abrasive layer tends to exert stronger forces on localized areas of the surface to be polished, so that the surface is scratched, thereby resulting in a quality problem. Moreover, the precision processing of a helical roller for emboss processing purposes adds to the cost of resulting products.

Another example is disclosed in Japanese Unexamined Patent Publication No. 55(1980)-117730, wherein a cleaning tape is produced by heating and pressing abrasive particles consecutively and in a stepwise fashion by means of a calender roller so that the particles can be buried in an abrasive layer. This method requires the use of an abrasive particle having a size of 0.3–5.0 micrometers. In this method, the surface of the coating film is subsequently smoothed by heating the coating film to 20–60 centigrade by the calender roller while the pressure of the calender roller is kept constant (for example, 200 kg/cm), or by gradually pressing the coating film by means of the calender roller under a pressure within a range of 200 kg/cm while the temperature is kept constant (for example, 60 centigrade), or by gradually heating and pressing the coating film under a pressure within a range of 200 kg/cm. The surface of the resultant coating film thus produced is provided with a gradually coarse or gradually smooth surface, which in turn causes a clog of the magnetic head to be easily removed, thereby leads to a scratch-free magnetic head. However, the arbitrary burying of the abrasive particles in the abrasive layer causes the locations of tip ends of the abrasive particles and the depth of the recesses in the surface of the abrasive layer to become uneven. Since a large amount of abrasion wastes is resultantly produced by the burnishing of items such as a floppy disk, in some areas of the abrasive layer abrasion wastes may not be caught between abrasive particles, and hence resulting smears on the surface of a floppy disk due to the removal of abrasion wastes will be the cause of a problem.

SUMMARY OF THE INVENTION

In view of the foregoing descriptions and observations, the object of this invention is to provide a manufacturing method for an abrasive tape which is optimum as an abrasive tape for the burnishing of items such as a floppy disk, and which is significantly improved in terms of the prevention of scratches.

To this end, according to one aspect of this invention, there is provided a manufacturing method for an abrasive tape comprising the steps of:

- applying a coating liquid which contains as a major composition abrasive particles and a binder resin to a flexible substrate;
- drying the flexible substrate to produce an abrasive layer; and
- subjecting the abrasive layer to a surface smoothing treatment by passing the abrasive layer between pressure rollers in such a manner that the flexible substrate comes in contact with an elastic roller, whereas the abrasive layer comes in contact with a metal roller, and wherein the pressure rollers are composed of the elastic roller having a hardness number of 50–80 measured by a spring type hardness tester A and the metal roller, and are arranged opposite to each other.

A magnetic recording medium is manufactured by applying a magnetic layer being composed of magnetic powders onto a non-magnetic substrate; drying the magnetic layer; and subjecting the substrate to a surface smoothing treatment which is intended to improve the glaze, smoothness, packing density, and thickness uniformity of the magnetic layer. In these processes, the surface smoothing processing is carried out by transferring the surface smoothness of the metal roller to the surface of a magnetic recording medium, wherein the metal roller is heated and pressurized (a linear pressure of 50 to 500 kg/cm) while the magnetic layer comes in contact with the metal roller (a diameter of 180 to 260 mm), and the flexible substrate comes in contact with the elastic roller (a diameter of 220–300 mm).

The surface smoothing treatment according to this invention is completely different from a surface smoothing treatment which is intended in the field of a magnetic recording medium; namely, the surface smoothing treatment according to this invention is not to transfer a surface smoothness to the surface of a magnetic recording medium, but to align the positions of the tip ends of the abrasive particles to the same level by selectively pressing the abrasive particles.

FIG. 1 schematically illustrates one example of a fragmentary section of an abrasive tape according to this invention. In the drawing, the surface of an abrasive layer 2, which is composed of as a major composition abrasive particles 9 and a binder resin 8 provided on a flexible substrate 3, has localized areas 10 where the positions of tip ends of the abrasive particles become uneven. The flexible substrate 3 comes in contact with an elastic roller 5, whilst a metal roller 4 comes in contact with the abrasive layer 2. The abrasive layer formed on the flexible substrate 3 passes in the direction of the arrow A between the metal roller 4 and the elastic roller 5 which are arranged opposite to each other, so that the abrasive layer 2 is pressurized by the smooth surface of the metal roller 4. The abrasive particles 9 on the surface of the pressurized abrasive layer 2 are forcefully pressurized, and the hardness of the elastic roller 5 is appropriately adjusted, so that the abrasive particles 9 are not indiscriminately but selectively pressurized, and therefore the surface smoothing treatment is achieved. That is, it is considered that since forces are selectively transmitted to the tip ends of the abrasive particles 9, a binder 8 surrounding the abrasive particles is permanently deformed, and the tip ends of the abrasive particles 9 are then held at their depressed positions, thereby making the abrasive particles uniform.

According to the abrasive tape of this invention, the object of this invention is achieved; namely, the abrasive particles with the tip ends thereof uniformly positioned are obtained by bringing the metal roller in contact with the abrasive layer, bringing the elastic roller in contact with the flexible substrate, and by selecting the hardness of the elastic roller having a hardness number of 50 to 80 measured by a spring type hardness tester A. The term "hardness number measured by a spring type hardness tester A" used throughout this specification means the hardness measured by a tester specified by the JIS (Japanese Industrial Standards) code K6301, wherein the distance that a pin protruded out of a working surface through a hole is forced back by a roller surface when the roller is brought in contact with the working surface of the tester is represented by a scale.

When the hardness of the elastic roller is a hardness number of 50 or less measured by the spring type hardness tester A, it is considered that no effects of the surface smoothing treatment are yielded because forces transmitted from the metal roller fail to travel to the position where the tip ends of the abrasive particles are permanently deformed, so that pressurized abrasive particles resume their positions. To the contrary, when the hardness of the elastic roller is a hardness number of 80 or more measured by a spring type hardness tester A, the pressurized abrasive particles get into the binder resin, whereupon the transfer of the smooth surface of the metal roller becomes stronger, and hence it is considered that a polishing effect of the abrasive particles is lost because the protruding degrees of the tip ends of the abrasive particles are decreased. From the descriptions set forth above, the hardness number of the elastic roller measured by the spring type hardness tester A should be kept generally within a range of 50 to 80, preferably within a range of 55 to 75, and particularly preferably within a range of 55 to 65.

Various approaches for maintaining the hardness of the elastic roller within the foregoing ranges when it is pressurized exist in the prior art, but the most popular approach is that the elastic roller is heated at a temperature within a range of 30 to 70 centigrade. Unlike the approach disclosed in Japanese Unexamined Patent Publication No. 55(1980)-117730 wherein pressurizing forces of a roller are varied, or the temperature of a coating film is changed, another approach is adopted in this patent application wherein the tip ends of the abrasive particles are aligned by adjusting the hardness of the pressurizing rollers arranged opposite to each other while the roller pressure and the temperature of the coating film are maintained constant.

FIG. 2 is a fragmentary sectional view showing one example of a roller system used in the manufacturing method of an abrasive tape according to the present invention. In the drawing, according to the manufacturing method for an abrasive tape of this invention, an abrasive tape 1, prior to a surface smoothing treatment, which is composed of the abrasive layer 2 laid on the flexible substrate 3, and which is supplied from a feed roller 1 passes in the direction of the arrow B between pressurizing rollers for surface smoothing purposes in such a manner that the abrasive layer 2 comes in contact with the metal roller 4, whereas the flexible substrate 3 comes in contact with the elastic roller 5. An abrasive tape is then produced by heating the surface of the elastic roller 5 by means of a heating source 6 immediately before the pressurizing so that the surface hardness of the elastic roller 5 is appropriately maintained constant, and by taking up the abrasive tape by means of a take-up roller 7. The rollers used for the surface smoothing treatment are hollow so that they can be heated or cooled, and hence the temperature of the rollers can be controlled by heating the inside of the roller with hot water, by electric heating, or by induction heating. Similar results will be obtained either by subjecting the abrasive tape to the surface smoothing treatment once it is taken up after the abrasive layer has been formed or by subjecting the abrasive tape to the surface smoothing treatment successively after the abrasive layer has been produced.

The metal roller used in the manufacturing method of the present invention is made of cast steel, and is mirror-finished after the body of the roller has been subjected to a setting treatment. A stainless steel roller or a metal roller, the surface of which is galvanized by chrome, zinc, tin, copper, nickel, or the like, may be used as the material of the metal roller.

A metal core produced by the steps of piling up raw cotton, pulp, wool, asbestos, or the like, in the form of a wire, a mat, or a paper sheet around the core; pressurizing the piled material; and cutting and polishing the surface of the core, or a metal roller with the surface thereof coated with a resilient material layer such as a rubber material and a plastic material can be used as the elastic roller used in the manufacturing method of the present invention. A polyamide resin or an epoxy resin may be used as the plastic material for coating purposes.

Abrasive particles, which are the major composition in the abrasive layer of the abrasive material, having a general average particle diameter of 0.3 to 5.0 micrometers can be utilized. Abrasive particles having an average particle diameter of 0.3 micrometers or less provides an excessive smoothness, as a result of which the polishing effect is lost. Meanwhile, abrasive particles having an average particle diameter of 5.0 micrometers or more may cause more scratches, and hence it must be paid much attention to the average particle diameter of the abrasive particles.

Materials that are suited as abrasive particles in accordance with the practice of the present invention are, for example, α-alumina, γ-alumina, fused alumina, silicon carbide, chromium oxide, cerium oxide, corundum, α-iron oxide, emery (major component: corundum and magnetic iron ore), quartzite, silicon nitride, boron nitride, and combinations thereof. The preferred type of material is a material having a Moh's hardness of 6 or more. In the practice of the present invention, the foregoing materials can be used alone or with any combinations of two to four thereof.

The flexible substrate used in the practice of the manufacturing method of the present invention can be selected from films or sheets which are made of, for example, polyester group such as polyethylene terephthalate (PET), polyethylene naphtalate, polyolefine group such as polypropylene, cellulose derivative such as cellulose triacetate and cellulose diacetate, vinyl-based resin such as polyvinyl chloride and polyvinylidene chloride, synthetic resin such as polycarbonate, polyamide, polyamideimide, or the like.

Existing known thermoplastic resins, thermoset resins, reactive resins, or the combination thereof can be used as the binder resin which is the major composition of the abrasive layer of the abrasive tape according to the present invention. As a thermoplastic resin, for example, polyvinyl-polyvinylidene copolymer, vinyl chloride-vinyl acetate-vinyl alcohol copolymer, and vinyl chloride-vinyl acetate-maleic acid copolymer can be used. Materials that are suited as thermoset resin or reactive resin materials in accordance with the practice of the present invention are, for example, nitrocellulose, epoxy resin, isocyanate resin, polyamide, polyamine, and combinations thereof. The foregoing materials can be used alone or with any combinations of two or more thereof.

In the manufacture of the abrasive layer of the abrasive tape according to the manufacturing method of this invention, the abrasive particles and the binder resin are kneaded together to produce a coating fluid, if necessary, along with a further addition of additives and solvents. Solvents, such as methyl ethyl ketone which are generally used for coating fluids of the abrasive tape, can be used as the solvent used for the kneading of the abrasive particles and the binder. Procedures of the kneading process and the loading order of each composition can be adequately set. Examples of a kneading machine which is used for the adjustment of the coating fluid include a ball mill, a twinroll mill, and a three-roll mill. The coating fluid may include existing materials such as a lubricant, a dispersant, and an antistatic agent.

Application techniques employed in the fabricating method for an abrasive tape according to this invention include, for example, known air doctor coating and blade coating techniques. The thickness of the abrasive layer applied by these techniques is usually about 0.5 to 1.0 micrometers and, preferably, 1.5 to 7.0 micrometers after the abrasive layer is dried.

DETAILED DESCRIPTION OF THE PREFERRED EMBODIMENTS

Figure 1:
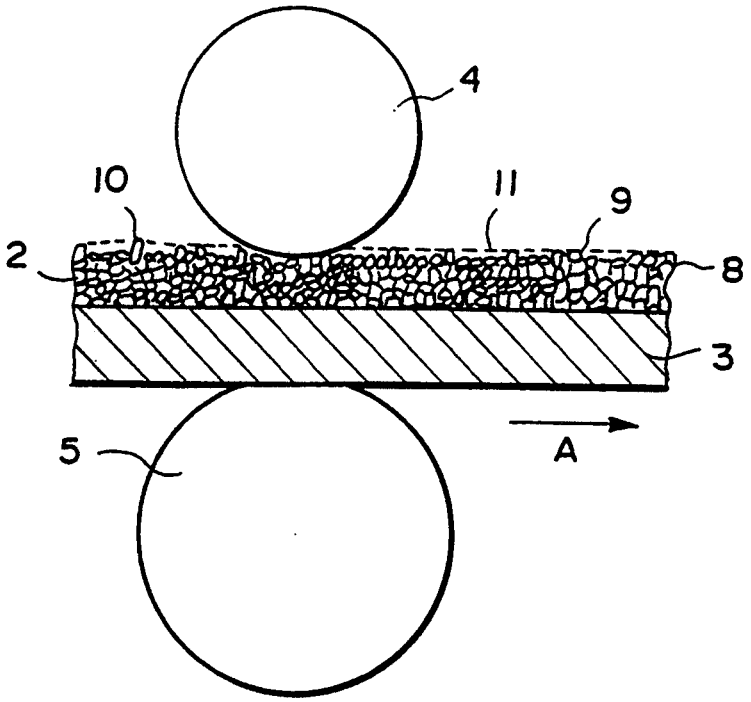
FIG. 1 is a fragmentary sectional view schematically showing a surface smoothing treatment in a manufacturing method for an abrasive tape according to this invention.
Figure 2:
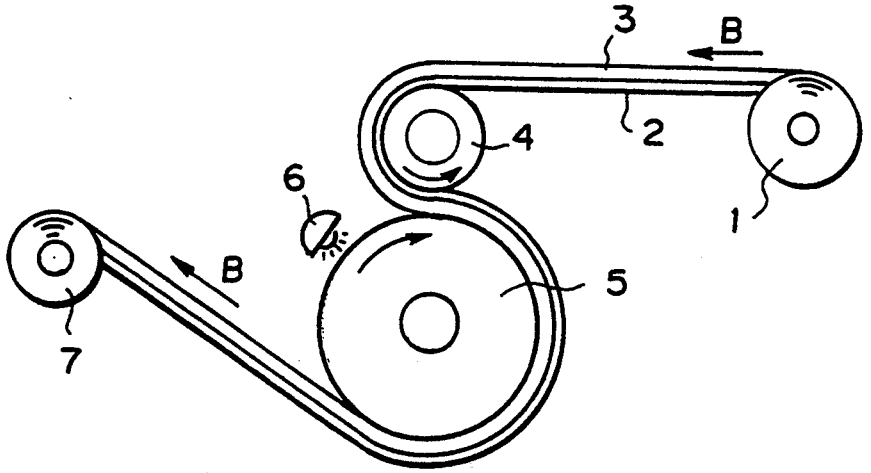
FIG. 2 is a fragmentary sectional view showing a roller system used in the manufacturing method for an abrasive tape according to this invention.

With reference to the accompanying drawings, preferred embodiments and comparative examples of this invention will be described in detail hereinbelow. Throughout the specification, the term "part" means "part by weight" unless otherwise specified. Various modifications and variations of compositions and the ratio of compositions disclosed in the specification may easily be contemplated by those who are skilled in the art without departing from the scope of the invention. Therefore, it is to be noted that the present invention is not limited to illustrative embodiments of this invention which will be described below.

First Embodiment (Composition of Coating Fluid for use with Abrasive Layer)

abrasive particles . . . 100 parts
chromic oxide ($Cr_2O_3$) (in the form of a granule, average particle diameter of 0.3 micrometers, Moh's hardness of 8) binder resin vinyl chloride-vinyl acetate copolymer . . . 2.5 parts
polyamide resin . . . 11 parts
epoxy resin . . . 1.1 parts
solvent . . . 85 parts A coating fluid (viscosity: 0.5 stokes) having the above compositions, wherein the fluid is dispersed using a ball mill, is applied onto a substrate which is made of polyethylene terephthalate having a thickness of 23 micrometers so that the thickness of the abrasive layer can be 5 micrometers after the coating is dried. The abrasive layer is dried to produce an abrasive layer under conditions which include a speed of 60 m/min., a front section temperature of 40 centigrade, a middle section temperature of 80 and a rear section temperature of 120 centigrade. Thereafter, the abrasive layer is subjected to a surface smoothing treatment by means of a plastic elastic roller P2 (a diameter of 300 mm), which uses a polyamide resin having a hardness of 60 measured by a spring type hardness tester A, and a metal roller (a diameter of 260 mm) the surface of which is galvanized by chrome. The resultant abrasive layer is then slit with a width of 1 inch to produce a resulting abrasive tape for burnishing purposes.

Second Embodiment

An abrasive tape for burnishing purposes is manufactured by slitting a substrate with an abrasive layer laid thereon to a width of 1 inch under the same conditions as those of the first embodiment except that the surface smoothing treatment is carried out using an elastic roller P1 having a hardness of 50 instead of the roller P2 which has a hardness of 60 (measured by the spring type hardness tester A).

Third Embodiment

An abrasive tape for burnishing purposes is manufactured by slitting a substrate with an abrasive layer laid thereon to a width of 1 inch under the same conditions as those of the first embodiment except that the surface smoothing treatment is carried out using an elastic roller P3 having a hardness of 80 instead of the plastic elastic instead of the roller P2 which has a hardness of 60 (measured by the spring type hardness tester A).

Fourth Embodiment

An abrasive tape for burnishing purposes is manufactured by slitting a substrate with an abrasive layer laid thereon to a width of 1 inch under the same conditions as those of the first embodiment except that the surface smoothing treatment is carried out using an elastic roller U, which is made of a woolen, instead of the plastic elastic roller.

Fifth Embodiment

An abrasive tape for burnishing purposes is manufactured by slitting a substrate with an abrasive layer laid thereon to a width of 1 inch under the same conditions as those of the first embodiment except that the surface smoothing treatment is carried out using a rubber elastic roller G instead of the plastic elastic roller.

Sixth Embodiment

An abrasive tape for burnishing purposes is manufactured by slitting a substrate with an abrasive layer laid thereon to a width of 1 inch under the same conditions as those of the first embodiment except that the surface smoothing treatment is carried out while the hardness of the plastic elastic roller is changed from 60 to 50 which is measured by the spring type hardness tester A by heating the surface of the plastic elastic roller, and maintaining the heated surface at a temperature of 50 centi-grade.

Seventh Embodiment

An abrasive tape for burnishing purposes is manufactured by slitting a substrate with an abrasive layer laid thereon to a width of 1 inch under the same conditions as those of the first embodiment except that the surface smoothing treatment is carried out while the hardness of the plastic elastic roller is changed from 60 to 50 which is measured by the spring type hardness tester A by heating the surface of the plastic elastic roller by means of a heater, and maintaining the heated surface at a temperature of 60 centigrade.

Eighth Embodiment

An abrasive tape for burnishing purposes is manufactured by slitting a substrate with an abrasive layer to a width of 1 inch under the same conditions as those of the first embodiment except that the surface smoothing treatment is carried out while the hardness of the plastic elastic roller is changed from 60 to 50 which is measured by the spring type hardness tester A by heating the surface of the plastic elastic roller by means of a heater, and maintaining the heated surface at a temperature of 70 centigrade.

Ninth Embodiment

An abrasive tape for burnishing purposes is manufactured by slitting a substrate with an abrasive layer laid thereon to a width of 1 inch under the same conditions as those of the first embodiment except that the surface smoothing treatment is carried out while the pressurizing force and hardness of the plastic elastic roller are respectively changed from 100 kg/cm to 50 kg/cm and 60 to 50 (measured by the spring type hardness tester A).

Tenth Embodiment

An abrasive tape for burnishing purposes is manufactured by slitting a substrate with an abrasive layer laid thereon to a width of 1 inch under the same conditions as those of the first embodiment except that the surface smoothing treatment is carried out while the pressurizing force and hardness of the plastic elastic roller are respectively changed from 100 kg/cm to 150 kg/cm and 60 to 50 (measured by the spring type hardness tester A).

Eleventh Embodiment

An abrasive tape for burnishing purposes is manufactured by slitting a substrate with an abrasive layer laid thereon to a width of 1 inch under the same conditions as those of the first embodiment except that the surface smoothing treatment is carried out while the pressurizing force and hardness of the plastic elastic roller are respectively changed from 100 kg/cm to 200 kg/cm and 60 to 50 (measured by the spring type hardness tester A).

Twelfth Embodiment

An abrasive tape for burnishing purposes is manufactured by slitting a substrate with an abrasive layer laid thereon to a width of 1 inch under the same conditions as those of the first embodiment except that the surface smoothing treatment is carried out while the abrasive particles are changed from $Cr_2O_3$ (in the form of a granule, average particle diameter of 0.3 micrometers, Moh's hardness of 8) to $\alpha$-alumina (in the form of a granule, average particle diameter of 4.0 micrometers, Moh's hardness of 9.0), and the hardness of the plastic elastic roller is changed from 60 to 50 (measured by the spring type hardness tester A).

Thirteenth Embodiment

An abrasive tape for burnishing purposes is manufactured by slitting a substrate with an abrasive layer laid thereon to a width of 1 inch under the same conditions as those of the first embodiment except that the surface smoothing treatment is carried out while the abrasive particles are changed from $Cr_2O_3$ (in the form of a granule, average particle diameter of 0.3 micrometers, Moh's hardness of 8) to $\alpha$-alumina (in the form of a granule, average particle diameter of 3.0 micrometers, Moh's hardness of 9.0), and the hardness of the plastic elastic roller is changed from 60 to 50 (measured by the spring type hardness tester A).

Comparative Example 1

An abrasive tape was manufactured by slitting a substrate with an abrasive layer laid thereon to a width of 1 inch in the same manner as that in the Example 1 except that a surface smoothing treatment was not carried out.

Comparative Example 2

An abrasive tape was manufactured by slitting a substrate with an abrasive layer laid thereon to a width of 1 inch in the same manner as that in the Example 1 except that a surface smoothing treatment was carried out with the plastic elastic roller changed to a metal roller. In this example, the abrasive performance dropped 60% when compared with the comparative example 1.

Comparative Example 3

An abrasive tape is manufactured by slitting a substrate with an abrasive layer laid thereon to a width of 1 inch in the same manner as that in the Example 1 except that the surface smoothing treatment was not carried out with abrasive particles changed from $Cr_2O_3$ (in the form of a granule, average particle diameter 0.3 micrometers, Moh's hardness 6–7) to α-alumina (in the form of a granule, average particle diameter 4.0 micrometers, Moh's hardness 1.2–9.6).

Comparative Example 4

An abrasive tape is manufactured by slitting a substrate with an abrasive layer laid thereon to a width of 1 inch in the same manner as that in the Example 1 except that the surface smoothing treatment was not carried out with abrasive particles changed from $Cr_2O_3$ (in the form of a granule, average particle diameter 0.3 micrometers, Moh's hardness 8) to α-alumina (in the form of a granule, average particle diameter 3.0 micrometers, Moh's hardness 9.0).

The average particle diameter of the abrasive material is a mean value obtained by measuring the size of 500 particles randomly sampled over a transmission type electron microscope picture.

The number of scratches generated on the surface of a floppy disk and an output from the floppy disk were measured using a burnishing polisher type FB-35 (which is available from High Tech Seiko Co., Ltd. Japan) after a 3.5"floppy disk is burnished with abrasive tapes prepared by the Embodiments 1–13 and Comparative Examples 1–4. The number of scratches represents a total number of scratches, which were generated on 50 planes of a floppy disk, measured by a microscope having a magnifying power of 20×. Provided that the output of the comparative example 1 is assumed as 100%, the output is a relative value with respect to the comparative example 1 by measuring an output level provided as an output from a Certifier-HFQ-35 (produced by High Tech Seiko Co., Ltd. Japan). Evaluation results set forth above are listed in the following table.

TABLE 1

| | Abrasive Material | | Surface Smoothing Treatment | | | | Burnishing Performance | |
|---|---|---|---|---|---|---|---|---|
| | Types | Average Particle Diameter (μm) | Metal Roller | Elastic Roller | Pressuring Force (kg/cm) | Surface Temp. of Elastic Roller (°C.) | Number of Scratches | Output (%) |
| Exp.1 | Chromic oxide | 0.3 | M | P2 | 100 | 30 | 1 | 98 |
| Exp.2 | Chromic oxide | 0.3 | M | P1 | 100 | 30 | 3 | 103 |
| Exp.3 | Chromic oxide | 0.3 | M | P3 | 100 | 30 | 10 | 97 |
| Exp.4 | Chromic oxide | 0.3 | M | U | 100 | 30 | 15 | 96 |
| Exp.5 | Chromic oxide | 0.3 | M | G | 100 | 30 | 18 | 98 |
| Exp.6 | Chromic oxide | 0.3 | M | P1 | 100 | 50 | 4 | 103 |
| Exp.7 | Chromic oxide | 0.3 | M | P1 | 100 | 60 | 1 | 101 |
| Exp.8 | Chromic oxide | 0.3 | M | P1 | 100 | 70 | 1 | 100 |
| Exp.9 | Chromic oxide | 0.3 | M | P1 | 50 | 30 | 6 | 102 |
| Exp.10 | Chromic oxide | 0.3 | M | P1 | 150 | 30 | 2 | 100 |
| Exp.11 | Chromic oxide | 0.3 | M | P1 | 200 | 30 | 10 | 97 |
| Exp.12 | α-Alumina | 4.0 | M | P1 | 100 | 30 | 5 | 102 |
| Exp.13 | α-Alumina | 3.0 | M | P1 | 100 | 30 | 2 | 104 |
| Comp. Exp. 1 | Chromic oxide | 0.3 | | | No Treatment | | 60 | 100 |
| Comp. Exp.2 | Chromic oxide | 0.3 | M | M1 | 100 | 30 | 20 | 98 |
| Comp. Exp.3 | α-Alumina | 4.0 | | | No Treatment | | 70 | 98 |
| Comp. Exp.4 | α-Alumina | 3.0 | | | No Treatment | | 55 | 101 |

As is evident from the above results obtained from the examples and comparative examples, the abrasive tape prepared by the comparative example 1 wherein the surface smoothing treatment was not carried out caused 60 scratches. Meanwhile, the abrasive tape, prepared by the embodiments 1–3 wherein the surface smoothing treatment was carried out, exhibited a substantial drop of the number of resulting scratches.

The hardness of the elastic roller of the pair of the metal roller and the elastic roller, arranged opposite to each other, is adjusted in the range of 50 to 80 (measured by the spring type hardness tester A), it is assured that the tip ends of the abrasive particles are stably aligned to a uniform position, and spacing for catching abrasive wastes is ensured. As a result, it is possible to prevent abrasive wastes from attaching to a surface to be polished. Also, local forces do not exert on an article to be processed because the tip ends of the abrasive particles come in contact with the article, whereby it is possible to achieve a substantially scratch-free burnishing processing when items such as floppy disks are burnished using the abrasive tape manufactured by the technique according to the present invention.

What is claimed is:

1. A manufacturing method for an abrasive tape comprising the steps of:

applying a coating liquid of abrasive particles and a binder resin to a flexible substrate to form a layer so that the abrasive particles on a surface of the layer farthest from the substrate have tip ends located farthest from the substrate;

drying the flexible substrate to produce an abrasive layer; and aligning the tip ends of the abrasive particles to be equally distant from the substrate by passing the abrasive layer between pressure rollers in such a manner that the flexible substrate comes in contact with an elastic roller, whereas the abrasive layer comes in contact with a metal roller, and wherein the pressure rollers are composed of the elastic roller having a hardness of 50–80 measured by a spring type hardness tester A and the metal roller, and are arranged opposite to each other and wherein the elastic roller is heated to a temperature in the range of 30 to 70 degrees Celsius.

2. A manufacturing method for an abrasive tape as defined in claim 1, wherein the abrasive particles have particle diameter of 5 micrometers or less.

* * * * *